United States Patent [19]

Masoudi

[11] Patent Number: 4,824,290

[45] Date of Patent: Apr. 25, 1989

[54] METHOD OF CONSTRUCTING A RIGID STRUCTURE UPON THE BOTTOM OF A WATER AS WELL AS LOST CASING FOR PERFORMING SAID METHOD

[76] Inventor: Ahmad Masoudi, Pasdaran, Golestan 5, Heravi Sq., Mostafa Vafa Manesh St., After Mozafarian Alley, 16698 Tehran, Iran

[21] Appl. No.: 931,665

[22] Filed: Nov. 17, 1986

[30] Foreign Application Priority Data

Nov. 17, 1985 [IR] Iran ..... 26904

[51] Int. Cl.[4] ..... E02B 17/02; E02D 5/18; B22C 9/24

[52] U.S. Cl. ..... 405/203; 405/116; 405/195; 405/222; 52/437; 249/10; 249/144; 249/188; 264/31

[58] Field of Search ..... 405/116, 195, 203–205, 405/218, 222–224, 249, 280; 249/10, 144, 145, 188; 264/31; 52/421, 437, 439, 503, 596

[56] References Cited

U.S. PATENT DOCUMENTS

| | | | |
|---|---|---|---|
| 109,637 | 11/1870 | Lilienthal | 405/223 |
| 925,204 | 6/1909 | Liljencrantz | 405/222 |
| 1,054,224 | 2/1913 | Lynde et al. | 405/205 |
| 1,425,114 | 8/1922 | Luard | 405/195 |
| 1,595,099 | 8/1926 | Jacobson | 405/222 |
| 1,758,606 | 5/1930 | Jacobs | 405/204 X |
| 2,677,165 | 5/1954 | Copenhaver et al. | 264/31 |
| 3,402,559 | 9/1968 | Fukushima | 264/31 X |
| 4,118,941 | 10/1978 | Bruce et al. | 405/204 |
| 4,664,556 | 5/1987 | Dixon | 405/195 X |

FOREIGN PATENT DOCUMENTS

| | | | |
|---|---|---|---|
| 74918 | 5/1976 | Australia | 405/195 |
| 1135381 | 8/1962 | Fed. Rep. of Germany | 405/195 |
| 27189 | 3/1977 | Japan | 405/204 |
| 133931 | 8/1982 | Japan | 405/205 |
| 15099 | 6/1911 | United Kingdom | 405/222 |
| 1503208 | 3/1978 | United Kingdom . | |
| 876547 | 9/1981 | United Kingdom | 405/195 |

*Primary Examiner*—Dennis L. Taylor
*Assistant Examiner*—John A. Ricci
*Attorney, Agent, or Firm*—Brumbaugh, Graves, Donohue & Raymond

[57] ABSTRACT

This invention is a method and casing (1) for constructing a rigid structure upon the bottom of the water. The casing to be used is a lost pillar casing of particular shape. It is larger at the bottom than at a higher level and preferably is composed of flat plates formed into a polygonal cross sectional shape with similarity to a multiple sided pyramid. It can be combined with wall casings slit into recesses of the pillar casings. The wall casings can be double wall casings in which case concrete is filled therein and bulk stoney material is filled into the interior of the pillar casings or between the casings.

21 Claims, 3 Drawing Sheets

Fig-6
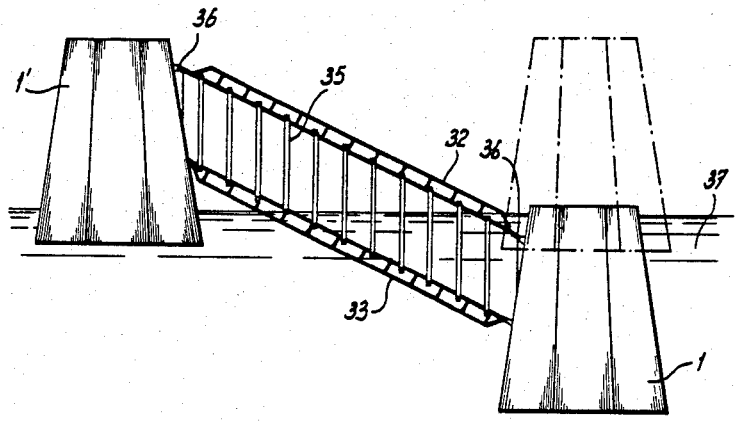
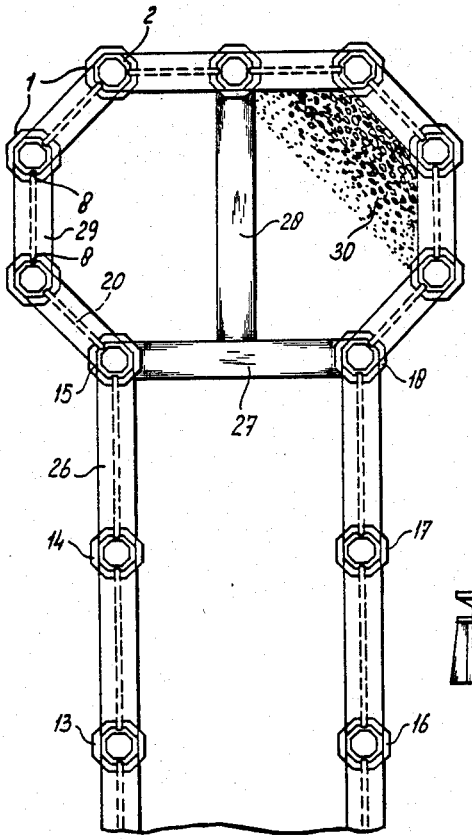
Fig-7
Fig-10
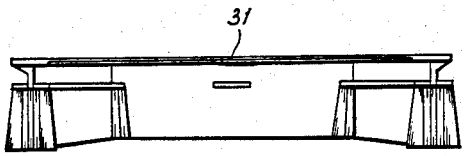

METHOD OF CONSTRUCTING A RIGID STRUCTURE UPON THE BOTTOM OF A WATER AS WELL AS LOST CASING FOR PERFORMING SAID METHOD

BACKGROUND OF THE INVENTION

The invention relates to a method of constructing a rigid structure upon the bottom of a body of water, such as a platform, a jetty, a pier, a column or the like, by making use of a hollow casing open at top and bottom, which casing is placed upon the bottom of the water with its top extending above water level and is lowered into the said bottom by removing material from the bottom area surrounded by the lower edge of the casing after the casing has been placed upon said bottom, It is used to construct the rigid load supporting structure by making use of a filling, and/or hardening material inside the casing.

Methods of this type are well known. It is for example known to place a casing of cylindrical or other cross section upon the bottom of the water, to remove soil from the bottom of the water, in particular in the area adjacent to the lower edge of the casing to enable said casing to move downwardly into the soil.

According to one known method the casing is filled with sand or stones.

According to another known method the space inside the casing is drained and, in the now free space a concrete structure is made. After completion the casing is removed.

According to another known method a sliding mold is used inside the casing and a tubular support is made with the aid of underwater concrete.

These known methods are deficient in that they are complicated and have to be adapted to the local conditions.

The purpose of the invention is to provide a method by means of which civil engineering structures, under a great variety of circumstances, in particular in water of varying depths and varying bottom circumstances, can be manufactured with the aid of standard elements which can be applied alone or in varying number.

SUMMARY OF THE INVENTION

According to the invention this purpose is achieved by constructing a double walled casing having a top which is smaller than the base and an inner and outer wall of which define a hollow space which is open at the top and closed at the bottom in a manner forming a sharp lower edge, placing reinforcing rods inside said hollow space and pouring concrete or the like hardening material into said hollow space after its positioning upon the bottom of the water. Such a casing has a relatively light weight but is sufficient to form a closure and connection with the bottom of the body of water. If necessary part of the hollow space is pre-filled inside the double wall with the concrete to overcome floating. If necessary the material of the water bottom is excavated by means of cutting tools and/or suction inside the space surrounded by the lower edge of the casing, so that the casing by its own weight penetrates into said bottom to the desired degree to obtain proper foundation. After filling the hollow space of the double-wall of the casing with a hardening material, such as concrete, a heavy and strong structure is obtained. The casing remains in place and functions as lost casing which provides for a finished outerside. If in the course of time corrosion would occur this would not effect the strength of the structure because inside the casing a reinforced concrete body is formed. This support structure can be used alone or in combination with identical structures placed at a distance from each other and interconnected by bridging elements, plates or the like. Said structures can function as columns supporting a platform.

In case a jetty or pier or the like has to be manufactured according to the invention this can be done in that a plurality of casings are placed upon the bottom of the water at a predetermined distance from each other, a double walled hollow wall is placed between adjacent casings after said casings have reached their final position upon and/ or within the bottom of the water and prior to completely filling said casings with concrete or the like, said wall having a sharp lower edge as well, which wall has substantially the same height from water bottom to the top as the casings and a length corresponding to the distance between opposite walls of adjacent casings, said casing walls after placement of the casing and walls are cut open at the location of the hollow space of the double-wall, reinforcing rods are placed from the inside of the hollow double-wall into the hollow space of the casings and concrete or the like is poured into the hollow spaces of the casings and wall. Also a double walled bridging element can be placed between opposite casings, the walls of the casings in that case might be cut away in the same way as the hollow walls are installed. These elements do not necessarily have a sharp lower edge nor do they necessarily extend to the water bottom. According to said method the casings which provide for column portions of the jetty become interconnected by the wall portions which extend from one casing to another casing and by the bridging section which extends across the pier from one casing to another. It also functions as a lost casing for the concrete filling which becomes integral with the concrete filling of the hollow space of the column forming casings.

According to the invention it can be advantageous if prior to the complete filling of the hollow space of the double wall and/or the casings with hardening material, the inner space of the casings defined by the inner wall of the casings is filled with filling material. This means that after placing a casing and completing its penetration into the soil of the bottom of the body of water the hollow inner space defined by the inner wall of the double-walled casing is filled with some kind of filling material such as sand, gravel, or stones. This can be done with or without binding material. This not only gives stability to the casing but increases its accessibility. This becomes clear if in accordance with the invention prior to the filling the hollow spaces of casing and double-wall with hardening material, the space between spaced apart walls and casings is filled with filling material. The filling material inside the casings and between walls that extend from one casing to another forms a surface of sufficient strength for the operation of devices necessary for the supply of the reinforcing rods and for the supply of the concrete.

In the case where the lost wall casings are of a predetermined length, they must initially be precisely positioned one with respect to the other.

According to the invention this can be achieved in that after placing one casing the next one is connected with the previous one by means of a parallelogram guiding system, comprising two parallel beams having their ends connected with the side walls of the already placed casing and the casing to be placed by means of joints with at least horizontal pivot axes. The parallel guiding system together with the pivotability of the parallel arms about a horizontal axis allows a new casing to be picked up from a supporting surface, such as the deck of a vessel by means of a hoisting device so that it can be lifted or lowered to reach a precise position with respect to the casing which has already been placed. This new casing also has to be dug into the soil and due to the parallel guide system it is ensured that the parallel position of the vertical axis of one casing with respect to the next casing is not disturbed. After the positioning of said next casing and preferably after having filled the interior with stones or the like the rods of the parallel guide system are removed and instead of said rods the lost wall casing is placed which casing can be connected with the casing of a column. Usually it will be sufficient to make a slot in the outer wall of the column casing, extend reinforcing rods through said slot and pour concrete in the lost casings for column and interconnecting wall. In this manner a supporting structure, such as a jetty, can be manufactured in a simple and precise manner and within a relatively short time. A unitary concrete structure is obtained coated by the metal of the lost casings upon which a platform deck or the like can be mounted.

The invention also deals with a casing for performing the method according to the invention which casing according to the invention has a conical shape at least in its lower portion with a largest width at the lower edge.

Preferably said casing throughout its height has a polygonal cross section. The conical shape provides for an excellent transfer of load upon the soil. The polygonal shape which preferably is octagonal provides ridigity for the casing when it is still empty and for the concrete structure after completion of the work. Moreover a polygonal conical shape composed of flat plates welded together at their edges is much easier to manufacture than a conical shape which has to be manufactured from curved plates.

According to the invention the casing at least at one side has been provided with a channel-shaped recess having its central plane in a vertical plane through the vertical axis of the casing, the width of said channel corresponding to the width of a wall which has to be connected to the casing. This channel-shaped recess facilitates the assembly of the conical casings with the lost wall casing.

Preferably the casing has two channel-shaped recesses in different side wall portions, e.g. opposite wall portions.

The preferred embodiment of the casing is one having at least a lower section of polygonal cross section and a base which is larger than the top of said section, and on top of said section a further polygonal section having side walls substantially parallel to the vertical axis of the casing.

It will be understood that necessary preparation of the soil of the bottom of water can take place in a known manner prior to lowering a casing. Removal of soil from the inside of a casing also can take place according to a known method usually with devices which cut the soil and suck away a mixture of water and soil.

BRIEF DESCRIPTION OF THE DRAWINGS

The invention now will be further elucidated with reference to the drawing in which:

FIG. 6 serves to illustrate the preferred method of placing casings at a proper distance with respect to each other.

FIG. 7 is a plan view of the jetty construction obtained by applying the methods according to the invention.

FIG. 10 is a cross section according to the line X—X of FIG. 8.

DETAILED DESCRIPTION OF THE PREFERRED EMBODIMENT

Figure 1:
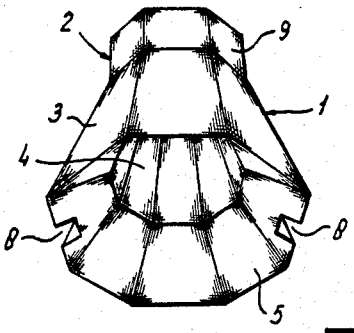
FIG. 1 is a perspective view from underneath of a casing to be used with the method according to the invention.
Figure 2:
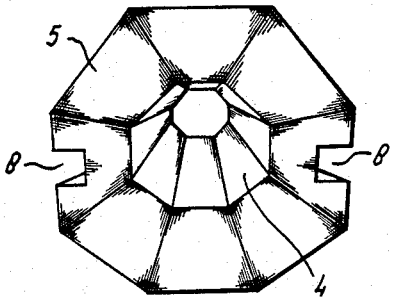
FIG. 2 is a view from below against the underside of the casing shown in FIG. 1.
Figure 3:
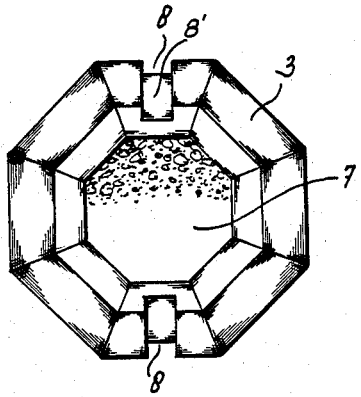
FIG. 3 is a top view of the casing shown in FIG. 1 and 2.
Figure 4:
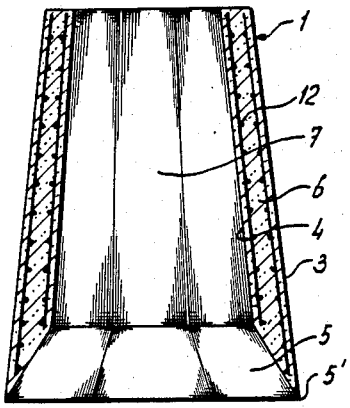
FIG. 4 is a longitudinal cross section through the lower part of the casing shown in FIG. 1.
Figure 5:
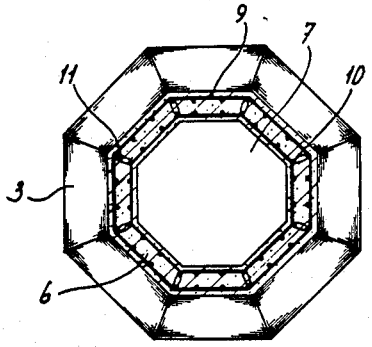
FIG. 5 is a top view of FIG. 4.
Figure 8:
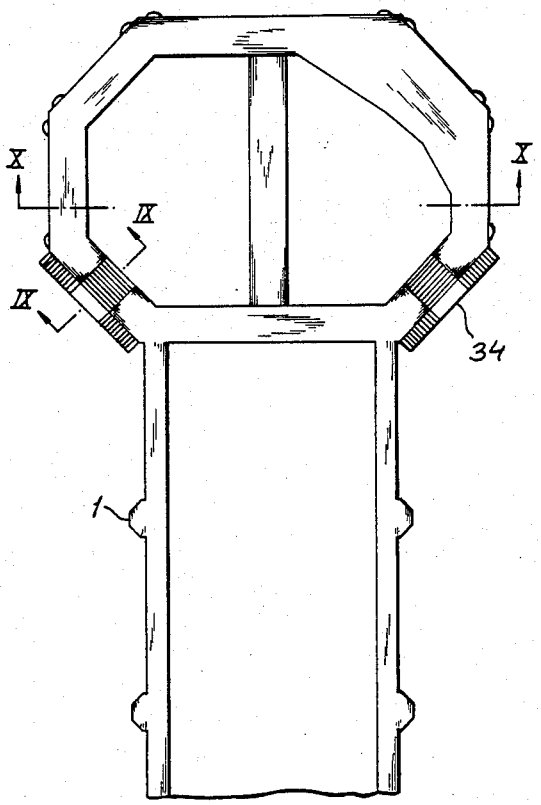
FIG. 8 is a plan view of the jetty of FIG. 7 to which has been added the top surface structure.

FIGS. 1, 2, 3, incl. show a casing for use in civil engineering structures which casing comprises a lower upwardly tapering portion 1 provided at the top with an upper portion 2 of constant cross section. Both portions 1 and 2 have a double wall formed by an outer casing 3 and an inner casing 4 which at the lower end are interconnected by a conical casing 5 such that a sharp lower edge is formed as shown at 5'. The outer casing 3 and the inner casing 4 of the lower portion 1 are composed of flat plates from sheet metal welded together. The same holds true for the upper portion 2 and for the connecting casing 5.

As shown in the drawings the cross section is polygonal, in particular octagonal. The hollow inner space 6 between the outer casing 3 and the inner casing 4 as well as between the outer casing and inner casing of the upper portion 2 provide space for the insertion of concrete reinforcing rods in general indicated with the reference 12. Spacers 11 can be provided where necessary between the inner and outer casing.

If necessary on top of the upper portion 2 further identical upper portions can be placed and/or a top portion which tapers upwardly and outwardly.

The inner space 7 of the casing can be filled with suitable filling material such as a mixture of cement/water (30%) and various sizes of stones (70%). Ideally this should be a mixture of soil and lime/ water (30%) and stones reduce costs.

As shown in FIGS. 1, 2, 3 incl. two opposite side walls of the casing shown can be provided with channel-shaped recesses 8, purpose of which will be described later.

Figure 9:
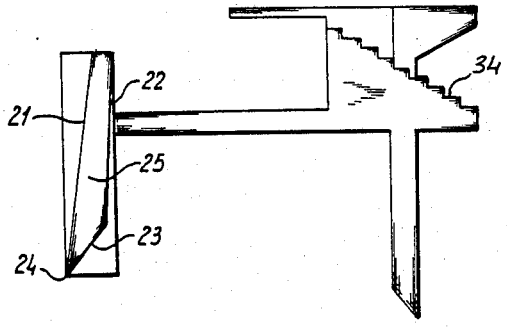
FIG. 9 is a cross section according to the line IX—IX of FIG. 8.

FIG. 7 shows a number of casings 1, 2 of which the casings 13, 14 15 and 16, 17, 18 respectively are placed in parallel whereas the other casings are placed according to a polygon to form a pier and a pier head or jetty. After positioning the casings and preferably after filling the inner spaces 7 with stony material wall casings 20 are placed, each wall casing being formed by a hollow wall 20 with an outer plate 21, an inner plate 22 (FIG. 9) and a bottom plate 23 forming a sharp edge 24. Said hollow wall casings can be placed inside the channel-shaped recesses 8 of the already placed casings and after said positioning of the wall casings 20 the bottoms 8' of the recesses are cut away. Reinforcing rods are subsequently placed inside the wall casings and through the gap formed by taking away the bottoms 8'. If subsequently concrete is poured into the hollow space 6 of the casing and the hollow space 25 of a wall casing, an integral wall will be obtained formed by a sequence of columns and interconnecting walls all coated by the metal plates of the lost casings 1, 2 and 20 respectively.

On top of this structure bridging elements 26, 27, 28 and 29 can be placed. The space defined by the sequence of walls and columns as shown in the plan view of FIG. 7 can then be filled with filling material as indicated at 30. This can take place prior to the pouring of concrete into the lost casings, but also can be done afterwards. According to the invention it is preferred to do it prior to the pouring of the concrete to obtain a surface which provides for access to the casings.

Upon the structure obtained with the method according to the invention and as shown in FIG. 7 a top platform can be arranged and further top structures with a staircase as shown at 34 and a platform plate 31.

FIG. 6 discloses the method according to the invention for positioning a casing 1 in proper distance with respect to an already placed casing.

FIG. 6 shows a casing 1 which already has been placed and a casing 1' which has to be placed. The two casings are interconnected by means of a parallel guide system formed by an upper beam 32, a lower beam 33 and interconnecting rods 35. The two beams 32, 33 have a pivot connection 36 with the casings 1 and 1' respectively which pivot connection has at least a horizontal pivot axis. This means that the casing 1' can be swung upwardly and downwardly and laterally in case a vertical pivot axis would be used as well. After lowering upon the water bottom 37 the casing will be at the proper distance from casing 1. After proper positioning of two casings with respect to each other and filling with stones and/or concrete the arms 32, 33 are removed and if so required a wall casing is placed between the casings 1 and 1'.

I claim:

1. A method of constructing a rigid structure upon the bottom of a body of water comprising:

constructing a lost casing of polygonal cross-section over its entire height and having a conical outer shape widest at a lower edge thereof by welding flat sheet metal plates into a hollow, double-walled casing having an open top end smaller than a bottom base end and flat outer and inner walls defining a casing hollow space open at the top end and closed at the bottom end so as to form a sharp lower edge;

placing the casing upon the bottom of the body of water at a depth of the water which is less than the height of the finished casing;

providing the inside of said hollow space with concrete reinforcing rods either before or after said casing has been placed on said bottom;

at least partially filling said casing hollow space with hardening material and removing material from the bottom where it contacts the sharp lower edge to further position said casing into the bottom of the body of water.

2. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

3. The method according to claim 2 further comprising:

filling an inner space of said casings defined by said inner wall with filler material before said casing hollow spaces defined by said double walls of said casing and said spaced-apart walls are completely filled with hardening material.

4. A method of constructing a rigid structure upon the bottom of a body of water comprising:

constructing a lost casing of polygonal cross-section over its entire height and having a conical outer shape widest at a lower edge thereof by welding flat sheet metal plates into a hollow, double-walled casing having an open top end smaller than a bottom base end and flat outer and inner walls defining a casing hollow space open at the top end and closed at the bottom end so as to form a sharp lower edge;

providing the inside of said hollow space with concrete reinforcing rods;

partially filling said casing hollow space with hardening material to ballast the casing as it is lowered in the body of water;

placing the casing upon the bottom of the body of water at a depth of the water which is less than the height of the finished casing;

pouring hardening material into said casing hollow space after it has been placed upon the bottom of the body of water; and removing material from the bottom where it contacts the sharp lower edge to further position said casing into the bottom of the body of water.

5. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

6. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other by connecting each of the plurality of casings to one another by means of a parallelogram guiding system including two parallel beams having first respective ends connected with a side wall of an already placed casing and second ends connected to a next casing to be placed by joint means having horizontal pivot axes, such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

7. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other by connecting each of the plurality of casings to one another by means of a parallelogram guiding system including two parallel beams having first respective ends connected with a side wall of an already placed casing and second ends connected to a next casing to be placed by joint means having horizontal pivot axes, such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

8. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other by connecting each of the plurality of casings to one another by means of a parallelogram guiding system including two parallel beams having first respective ends connected with a side wall of an already placed casing and second ends connected to a next casing to be placed by joint means having horizontal pivot axes, such that the top ends of said casings extend above water level;

placing a double walled bridging element as a lost casing between oppositely positioned casings;

removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

9. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge, on the bottom of the body of water a predetermined distance from each other by connecting each of the plurality of casings to one another by means of a parallelogram guiding system including two parallel beams having first respective ends connected with a side wall of an already placed casing and second ends connected to a next casing to be placed by joint means having horizontal pivot axes, such that the top ends of said casings extend above water level, placing a double walled bridging element as a lost casing between oppositely positioned casings;

removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

10. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge and each having at least one side provided with a channel-shaped recess of a predetermined width having its central plane coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls of said predetermined width between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

11. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge and each having at least one side provided with a channel-shaped recess of a predetermined width having its central plane coplanar with a vertical plane through a vertical axis of the casing, on the bottom of the body of water a predetermined distance from each other such that the top end of said casings extend above water level, removing material surrounding the lower edge of the casings at the bottom to further position said casings into said bottom of said body of water;

placing a plurality of spaced-apart double-walled hollow walls of said pre-determined width between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

12. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge and each having two channel shaped recesses on the sides thereof of a predetermined width disposed with their central planes coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

13. A method of constructing a rigid structure upon the bottom of a body of water comprising:

placing a plurality of hollow, double-walled casings each having an open top end smaller than a bottom base end and outer and inner walls defining a casing hollow space open at the top end and closed at the bottom end so as to form a sharp lower edge and each having two channel shaped recesses on the sides thereof of a predetermined width disposed with their central planes coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

14. A method of constructing a rigid structure upon the bottom of a body of water comprising:

constructing a lost casing having a base portion of a first polygonal cross-section and an upper portion of a second polygonal cross-section having side walls substantially parallel to a vertical axis of the casing, by welding flat sheet metal plates into a hollow, double-walled casing having an open top end smaller than a bottom base end and flat outer and inner walls defining a casing hollow space open at the top end and closed at the bottom end so as to form a sharp lower edge;

providing the inside of said hollow space with concrete reinforcing rods;

placing the casing upon the bottom of the body of water at a depth of the water which is less than the height of the finished casing;

pouring hardening material into said casing hollow space after it has been placed upon the bottom of the body of water, and removing material from the bottom where it contacts the sharp lower edge to further position said casing into the bottom of the body of water.

15. A method of constructing a rigid structure upon the bottom of a body of water comprising:

placing a plurality of hollow, double-walled casings each having a base portion of a first polygonal cross-section and an upper portion of a second polygonal cross-section having side walls substantially parallel to a vertical axis of the casing, and formed with an open top end smaller than a bottom base end and outer and inner walls defining a casing hollow space open at the top end and closed at the bottom end so as to form a sharp lower edge, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

16. A method of constructing a rigid structure upon the bottom of a body of water comprising:

placing a plurality of hollow, double-walled casings each having a base portion of a first polygonal cross-section and an upper portion of a second polygonal cross-section having side walls substantially parallel to a vertical axis of the casing, and formed with an open top end smaller than a bottom base end and outer and inner walls defining a casing hollow space open at the top end and closed at the bottom end so as to form a sharp lower edge, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

17. A method of constructing a rigid structure upon the bottom of a body of water comprising:

placing a plurality of hollow, double-walled casings each having a base portion of a first polygonal cross-section and an upper portion of a second polygonal cross-section having side walls substantially parallel to a vertical axis of the casing, and formed with an open top end smaller than a bottom base end and outer and inner walls defining a casing hollow space open at the top end and closed at the bottom end so as to form a sharp lower edge and each having at least one side provided with a channel-shaped recess of a predetermined width having its central plane coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls of said predetermined width between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

18. A method of constructing a rigid structure upon the bottom of a body of water comprising:

placing a plurality of hollow, double-walled casings each having a base portion of a first polygonal cross-section and an upper portion of a second polygonal cross-section having side walls substantially parallel to a vertical axis of the casing, and formed with an open top end smaller than a bottom base end and outer and inner walls defining a casing hollow space open at the top end and closed at the bottom end so as to form a sharp lower edge and each having at least one side provided with a channel-shaped recess of a predetermined width having its central plane coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls of said pre-determined width between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces;

filling the spaces between said casings and said spaced-apart hollow walls with filler material; and pouring hardening material into said casing hollow spaces and said spaced-apart hollow walls.

19. A method of constructing a rigid structure upon the bottom of a body of water comprising:

placing a plurality of hollow, double-walled casings each having a base portion of a first polygonal cross-section and an upper portion of a second polygonal cross-section having side walls substantially parallel to a vertical axis of the casing, and formed with an open top end smaller than a bottom base end and outer and inner walls defining a casing hollow space open at the top end and closed at the bottom end so as to form a sharp lower edge and each having two channel shaped recesses on the sides thereof of a predetermined width and having their central planes coplanar with a vertical plane through a vertical axis of the casing, on the bottom of the body of water a predetermined distance from each other such that the top ends of said casings extend above water level, removing material surrounding the lower edge of the casings at the bottom to further position said casings into said bottom of said body of water;

placing a plurality of spaced-apart double-walled hollow walls between adjacent casings, each of said spaced-apart walls extending from water bottom to the top end of said casings after said positioning thereof;

cutting open said casings to expose said casing hollow space at the location of said spaced-apart walls for connection thereto;

placing reinforcing rods from inside said hollow walls into said casing hollow spaces; and pouring hardening material into said casing hollow spaces and said spaced-apart hollow walls.

20. A method of constructing a rigid structure upon the bottom of a body of water comprising:

constructing a lost casing of polygonal cross-section over its entire height and having a conical outer shape widest at a lower edge thereof by welding flat sheet metal plates into a hollow, double-walled casing having an open top end smaller than a bottom base end and flat outer and inner walls defining a casing hollow space open at the top end and closed at the bottom end so as to form a sharp lower edge;

placing the casing upon the bottom of the body of water at a depth of the water which is less than the height of the finished casing;

providing the inside of said hollow space with concrete reinforcing rods either before or after said casing has been placed on said bottom;

removing material from the bottom where it contacts the sharp lower edge to further position said casing into the bottom of the body of water; and at least partially filling said casing hollow space with hardening material.

21. A method of constructing a rigid structure upon the bottom of a body of water comprising:

constructing a lost casing of polygonal cross-section over its entire height and having a conical outer shape widest at a lower edge thereof by welding flat sheet metal plates into a hollow, double-walled casing having an open top end smaller than a bottom base end and flat outer and inner walls defining a casing hollow space open at the top end and closed at the bottom end so as to form a sharp lower edge;

providing the inside of said hollow space with concrete reinforcing rods;

at least partially filling said casing hollow space with hardening material;

placing the casing upon the bottom of the body of water at a depth of the water which is less than the height of the finished casing; and removing material from the bottom where it contacts the sharp lower edge to further position said casing into the bottom of the body of water.

* * * * *